US009903692B2

(12) United States Patent
Arnold

(10) Patent No.: US 9,903,692 B2
(45) Date of Patent: Feb. 27, 2018

(54) METHOD AND DEVICE FOR CONTROLLING THE POWER TYPE AND POWER EMISSION OF A WARHEAD

(71) Applicant: TDW Gesellschaft für verteidigungstechnische Wirksysteme mbH, Schrobenhausen (DE)

(72) Inventor: Werner Arnold, Ingolstadt (DE)

(73) Assignee: TDW Gesellschaft für verteidigungstechnische Wirksysteme mbH, Schrobenhausen (DE)

( * ) Notice: Subject to any disclaimer, the term of this patent is extended or adjusted under 35 U.S.C. 154(b) by 0 days.

(21) Appl. No.: 15/225,475

(22) Filed: Aug. 1, 2016

(65) Prior Publication Data

US 2017/0146326 A1 May 25, 2017

(30) Foreign Application Priority Data

Aug. 8, 2015 (DE) ..... 10 2015 010 274

(51) Int. Cl.
*F42B 3/22* (2006.01)
*F42B 12/22* (2006.01)
(Continued)

(52) U.S. Cl.
CPC ..... *F42B 3/22* (2013.01); *F42B 3/10* (2013.01); *F42B 12/22* (2013.01); *F42B 12/208* (2013.01)

(58) Field of Classification Search
CPC .... F42B 3/22; F42B 3/10; F42B 12/22; F42B 12/208; F42B 12/24; F42B 12/26;
(Continued)

(56) References Cited

U.S. PATENT DOCUMENTS 4,848,239 A * 7/1989 Wilhelm ..... F42B 12/22 102/475
6,283,036 B1 * 9/2001 Munsinger ..... F42B 12/204 102/475

(Continued)

FOREIGN PATENT DOCUMENTS

DE 10 2006 048299 B3 9/2008
DE 10 2011 010351 A1 8/2012

(Continued)

OTHER PUBLICATIONS

German Search Report for Application No. 16001715 dated Dec. 6, 2016.

(Continued)

*Primary Examiner* — John Cooper
(74) *Attorney, Agent, or Firm* — Jenkins, Wilson, Taylor & Hunt, P.A.

(57) ABSTRACT

An initiation device and method allowing power output to be switched between blast generation and splinter generation. The device and method include a cylindrical warhead with a cylindrical, central explosive charge and a tubular perforated mask surrounding the explosive charge, and also with at least two ignition devices, the first ignition device arranged in a region of one of the head sides of the cylindrical charge, and the second ignition device arranged in a region around a center of a longitudinal axis of the warhead, and having a splinter-generating casing surrounding the perforated mask.

12 Claims, 1 Drawing Sheet

(51) Int. Cl.
*F42B 3/10* (2006.01)
*F42B 12/20* (2006.01)

(58) Field of Classification Search
CPC ..... F42B 12/28; F42B 12/32; F42B 12/207; F41A 11/00; F41A 3/66
USPC ..... 102/475, 476, 478, 479, 492–497
See application file for complete search history.

(56) References Cited

U.S. PATENT DOCUMENTS 8,033,224 B1 * 10/2011 Yelverton ..... F42B 1/028 102/306
8,250,986 B1 * 8/2012 Sheridan ..... F42B 12/207 102/322
8,522,685 B1 9/2013 Gold et al.
9,593,923 B1 * 3/2017 Gold ..... F42B 12/32
2004/0089185 A1 * 5/2004 Ronn ..... F42B 12/32 102/494
2011/0203475 A1 * 8/2011 Thuman ..... F42B 3/22 102/275.11
2012/0227609 A1 * 9/2012 Volkmann ..... F42B 3/16 102/322
2012/0291654 A1 * 11/2012 Wilson ..... F42B 12/24 102/492
2013/0042782 A1 * 2/2013 Haskins ..... F42B 12/207 102/478
2013/0239837 A1 * 9/2013 Ames ..... F42B 12/208 102/478
2015/0033971 A1 * 2/2015 Miller ..... F42B 12/10 102/476
2016/0003592 A1 * 1/2016 Nouguez ..... F42B 12/207 102/396
2017/0146326 A1 * 5/2017 Arnold ..... F42B 3/22

FOREIGN PATENT DOCUMENTS

DE 10 2011 118 462 A1 5/2013
EP 2312259 A1 4/2011
EP 2921813 A1 9/2015

OTHER PUBLICATIONS

German Office Action Application No. 10 2015 010 274 dated May 4, 2017.

* cited by examiner

METHOD AND DEVICE FOR CONTROLLING THE POWER TYPE AND POWER EMISSION OF A WARHEAD

CROSS-REFERENCE TO RELATED APPLICATION

This application claims priority to German Patent Application DE 10 2015 010 274.5 filed Aug. 8, 2015, the entire disclosure of which is incorporated by reference herein.

TECHNICAL FIELD

The disclosure herein relates to a method for controlling the power type and power emission of a cylindrical warhead comprising at least two ignition devices, the first of which is arranged in the region of one of the head sides and the second of which is arranged in the region around the center of the longitudinal axis of the warhead, and which are triggered either individually or at a selectable interval of time, exhibiting a cylindrical explosive charge with a tubular perforated mask surrounding the explosive charge, and comprising a splinter-forming casing surrounding the perforated mask.

BACKGROUND

Standard pressure (or more commonly referred to as "blast")/splinter charges with an explosive charge mass C (energy supplier) and a casing mass M are known in the art. The Gurney equation $\mu=M/C$ determines the velocity v, and therefore the impulse $I=Mv$ or the kinetic energy $E_{kin}=M/2v^2$ of the casing.

The residual energy of the total explosive energy $E_{tot}$ stored goes into the blast power $E_B$ of the explosive charge. These two components together, splinter energy and blast energy ($E_{kin}+E_B$), therefore determine the total power of a blast/splinter charge.

There is an optimum for the kinetic energy or else the impulse of a charge. The optimum depends on predefined marginal conditions; in this case, for example, a constant total mass and constant caliber. Alternatively, for example, a constant total volume could also be required.

The achievement of an optimum requires a given ratio of M and C to one another. This optimum is frequently sought if no other marginal conditions are specified, such as a thick charge casing for a penetrator to perforate structural targets with thick concrete walls, for example. There are therefore frequently constraints when it comes to deciding which M-to-C ratios can be chosen.

The maximum blast power that can possibly be attained requires the oxygen in the air to be used for the after-reaction, in other words for the combustion of the total explosive vapors produced to be utilized. This is because military explosives are heavily oxygen-underbalanced, i.e. the total possible blast power is only partially released during detonation. There are still a large number of incompletely oxidized molecules in the vapor, such as C, CO, HO (or extra added metal powder such as Al) rather than $CO_2$ and $H_2O$ (or $Al_2O_3$), for example. Complete oxidation of these vapors requires adequate blending with the ambient air, however.

Tests have revealed that these after-reactions with air can be entirely suppressed, i.e. there is only negligible after-combustion, leading to a correspondingly sharp reduction in blast power. It was possible to demonstrate in this case that the difference between the complete blast power and suppressed blast power is, for example, up to 400%.

The explanation for this phenomenon lies in the sharp temperature drop caused by adiabatic expansion of the vapor gases. Before the casing rips open and the explosive vapors are mixed with air and react with the oxygen, the vapors have cooled down to such an extent that they have fallen below the thresholds of the reaction temperatures for different gas molecules (e.g. CO)—there is a complete suppression of vapor reactions.

The problem addressed by the disclosure herein is therefore that of specifying a method with which a known warhead can easily be switched between splinter generation and pressure (blast) generation.

As has already been stated, the casing acts as a barrier between the expanding vapors and the ambient air. Any delay in removing this barrier results in the vapor temperatures having already fallen below the reaction thresholds, so that the reactions are suppressed.

SUMMARY

The problem is solved by the prompt removal of this barrier. There are two possible ways of doing this which can support and complement one another through coordination and harmonization.

According to the disclosure herein, the solution comprises a method with the following steps that can be selectively implemented:

- following the triggering of only the first ignition device and then ensuing deflection of the detonation front produced, which extends in a substantially glancing manner between the casing and the perforated mask made of a porous RSM (Reactive Structure Material), the detonation front is additionally damped by the perforated mask, as a result of which no chemical reaction takes place in the porous RSM and as a result of which the splinters of the casing are radially accelerated without a significant blast reaction taking place,
- following the triggering of only the second ignition device, the detonation front produced strikes the perforated mask made of a porous RSM substantially perpendicularly, as a result of which the explosive particles passing through the holes of the perforated mask fragment the casing and then the perforated mask too, and as a result of this a complete after-reaction of the explosive vapors then follows due to the oxygen which is then available,
- when the first and second ignition devices are triggered at selectable points in time, there is a distribution of splinter generation or blast generation that depends on the ignition timing.

Further advantageous embodiments can be inferred from the dependent claims.

A particular advantage of the solution according to the disclosure herein is that for the first time the optional use of different initiation sites in one case leads to the complete suppression of after-reactions and therefore to the selective elimination of the blast effect. In the other case, there is a complete after-reaction of the oxygen-underbalanced vapors and therefore an extremely high blast effect.

BRIEF DESCRIPTION OF THE DRAWINGS

Exemplary embodiments of the disclosure herein are depicted in the drawing and are described in greater detail below. In the drawing.

DETAILED DESCRIPTION

Figure 1:
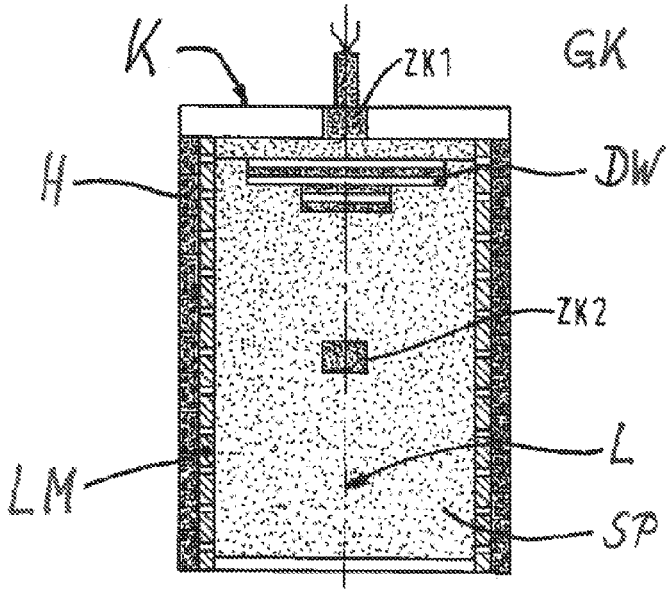
FIG. 1: shows a cylindrical warhead with an integrated perforated mask.

FIG. 1 shows a warhead GK with two different ignition points ZK1, ZK2 which can be initiated either individually but also jointly at selectable times. The one ignition device ZK1 is arranged on the head side K of the warhead GK in the region of a detonation wave deflector DW. The second ignition device ZK2 is mounted roughly centrally in the explosive charge SP on the longitudinal axis L of the warhead.

The centrally arranged explosive charge SP is surrounded by a perforated mask LM on the outside. This bears directly against the casing H of the warhead GK.

Figure 2:
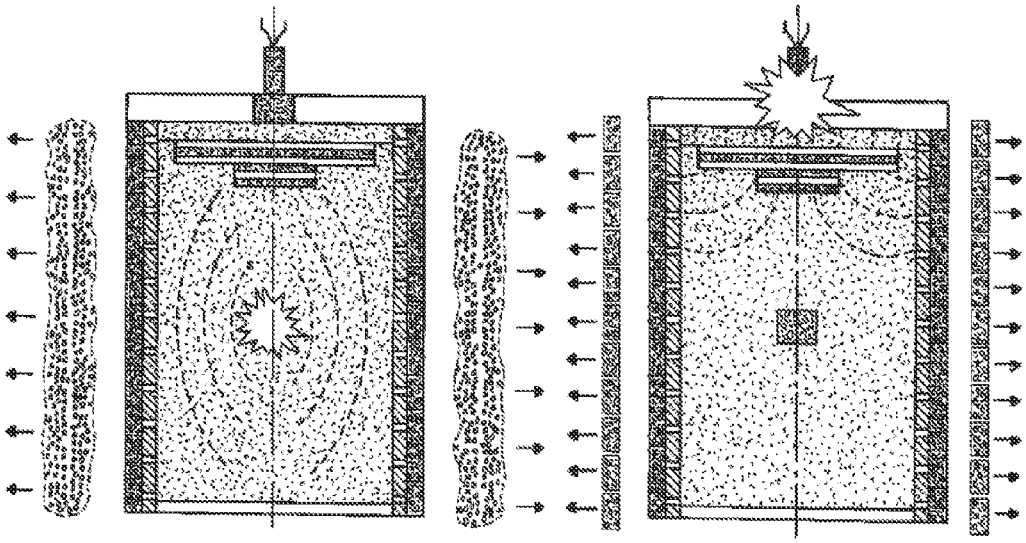
FIG. 2: shows different warhead initiation modes.

Depending on which ignition device is selected, a situation such as that depicted on the left or right in FIG. 2 results during the initiation of the ignition device according to the method described here. For this purpose, in respect of the known methods, those in extended form will be used.

On the one hand, the materials of the casing H and the strengths thereof are selected in such a manner that a strong, quick fragmentation and therefore early opening to allow the vapors to escape is guaranteed. This may be achieved through special sintering of metal particles, for example. High-density materials such as molybdenum or tungsten alloys are available for this.

On the other hand, this is supported by switchable methods of opening the casing. The functionality and switchability of the methods are depicted in FIG. 2. In the left partial image, the detonation fronts depicted using dotted lines strike the perforated mask LM perpendicularly at the front. This means that particle jets are produced very quickly, the particle jets exposing the casing to extreme loads and fragmenting it. On the right side of FIG. 2, a switch has been made to glancing mode. In this case, no more particle jets are produced and there is no early fragmentation of the casing. Consequently, the suppression of after-reactions also brings about the selective elimination of the blast effect.

In the left partial image in FIG. 2, the locally limited blast mode is depicted which avoids collateral damage. In this case, the casing fragmentation mode is activated. The casing is quickly and effectively fragmented and subfragmented into small and minutely small splinters which do not fly far, as they are quickly braked by the air. The vapors can escape quickly and mix with the surrounding air. There is a complete after-reaction of the oxygen-underbalanced vapors. An extremely high blast effect is therefore produced locally, due to the ultra-finely fragmented, rapid metal particles of the casing in addition to the blast from the 100% vapor reactions. Effects with a wider coverage (a few 100 m) are not desirable and neither are they to be expected.

The right partial image in FIG. 2 shows the known method of exclusive splinter formation. The method of fragmenting the casing is precluded in this case. This means that no particle jets are produced. Detonation takes place as usual, so that the splinters (whether natural or preformed splinters) are not fragmented or subfragmented, but they are accelerated as customary and fly over large distances (a few hundred meters) and are able to be fully and effectively deployed in the military target. There is a cessation of after-reactions and a very sharply reduced blast effect. This is in any case confined to a limited area and is not required here to support the power output.

It is of course also possible by a roughly simultaneous initiation of both ignition devices ZK1 and ZK2 for a mixed form of the two aforementioned effects to be achieved.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A method for controlling power type and power emission of a cylindrical warhead comprising a head side that is arranged on a first end thereof along a longitudinal axis of the warhead, an outer casing that is coaxial with the longitudinal axis, a tubular perforated mask that comprises a porous reactive structure material and is contained within the casing, and an explosive charge contained, at least partially, within the perforated mask, wherein the warhead comprises a first detonation mode, a second detonation mode, and a third detonation mode, the method comprising:

arranging a first ignition device in a region of the head side of the warhead;

arranging a second ignition device in a region of a center of the warhead; and initiating the warhead by triggering the first detonation mode where only the first ignition device is triggered, triggering the second detonation mode where only the second ignition device is triggered, or triggering the third detonation mode where both of the first and second ignition devices are triggered either simultaneously or at different selectable points in time, wherein, when only the first ignition device is triggered according to the first detonation mode, a first detonation front is produced, which is deflected by a detonation wave deflector that guides the first detonation front in a glancing manner onto the perforated mask, which damps the first detonation front, such that ignition of the warhead occurs without any chemical reaction in the perforated mask, so that splinters of a first size range are formed from the casing by the first detonation front and are accelerated radially away from the warhead without a significant blast reaction occurring;

wherein, when only the second ignition device is triggered according to the second detonation mode, a second detonation front is produced, propagating in a direction perpendicular to, and striking, the perforated mask, such that explosive particles pass through holes of the perforated mask, fragmenting the casing and the perforated mask to form splinters of a second size range, which are smaller than the splinters of the first size range, and effecting a complete after-reaction of explosive vapors due to oxygen, which is made available due to the fragmenting of the casing and the perforated mask; and wherein, when the first and second ignition devices are triggered at either simultaneously or at the selectable points in time according to the third detonation mode, a distribution of splinter generation or blast generation can be effected, depending on which of the selectable points in time are selected.

2. The method of claim 1, wherein the warhead comprises a plurality of head sides, and wherein the first ignition device is arranged at one of the plurality of head sides.

3. The method of claim 2, wherein the center of the warhead is at a midpoint of a length of the warhead, as measured along the longitudinal axis of the warhead.

4. The method of claim 1, wherein the center of the warhead is coaxial with the longitudinal axis of the warhead.

5. The method of claim 1, wherein the casing comprises a single continuous internal volumetric space, and wherein the first ignition device and the second ignition device are both disposed at or within the single continuous internal volumetric space.

6. A device for controlling power type and power emission of a warhead, the device comprising:

a cylindrical warhead with a head side that is arranged on a first end thereof along a longitudinal axis of the warhead, an outer casing that is coaxial with the longitudinal axis, a tubular perforated mask contained within the casing, an explosive charge contained, at least partially, within the perforated mask, a first ignition device arranged at the head side of the warhead, and a second ignition device arranged in a region of a center of the warhead, wherein the perforated mask comprises a porous reactive structure material, wherein the warhead comprises a first detonation mode where only the first ignition device is triggered, a second detonation mode where only the second ignition device is triggered, and a third detonation mode where both the first and second ignition devices are triggered either simultaneously or at different selectable points in time, wherein, when only the first ignition device is triggered according to the first detonation mode, a first detonation front is produced, which is deflected by a detonation wave deflector that guides the first detonation front in a glancing manner onto the perforated mask, which is configured to provide additional damping for the first detonation front, so that ignition occurs without any chemical reaction in the perforated mask, so that splinters of a first size range are formed from the casing by the first detonation front and are accelerated radially away from the warhead without a significant blast reaction occurring;

wherein, when only the second ignition device is triggered according to the second detonation mode, a second detonation front is produced, which propagates in a direction perpendicular to the perforated mask, such that explosive particles pass through holes of the perforated mask to fragment the casing and the perforated mask to form splinters of a second size range, which are smaller than the splinters of the first size range, such that a complete after-reaction of explosive vapors can be effected due to oxygen, which is available to the explosive charge by the casing and the perforated mask being fragmented; and wherein, when the first and second ignition devices are triggered either simultaneously or at the selectable points in time according to the third detonation mode, a distribution of splinter generation or blast generation can be effected, depending on which of the selectable points in time are selected.

7. The device of claim 6, wherein the casing and perforated mask are made of the porous reactive structure material.

8. The device of claim 7, wherein the casing and perforated mask are made of different reactive structure material.

9. The device of claim 6, wherein the warhead comprises a plurality of head sides, and wherein the first ignition device is arranged at one of the plurality of head sides.

10. The device of claim 6, wherein the center of the warhead is coaxial with the longitudinal axis of the warhead.

11. The device of claim 10, wherein the center of the warhead is at a midpoint of a length of the warhead, as measured along the longitudinal axis of the warhead.

12. The device of claim 6, wherein the casing comprises a single continuous internal volumetric space, and wherein the first ignition device and the second ignition device are both disposed at or within the single continuous internal volumetric space.

* * * * *